United States Patent [19]

Alexander

[11] Patent Number: 4,658,901

[45] Date of Patent: Apr. 21, 1987

[54] METHOD OF AND APPARATUS FOR REMOVING STUCK WELL PIPE

[76] Inventor: Ivan D. Alexander, P.O. Box 71, Anza, Calif. 92306

[21] Appl. No.: 771,737

[22] Filed: Sep. 3, 1985

[51] Int. Cl.[4] ..... E21B 31/113

[52] U.S. Cl. ..... 166/301; 166/98; 166/178; 175/293; 173/91; 294/86.23

[58] Field of Search ..... 166/98, 301, 177, 178; 175/293, 296, 297; 294/86.1, 86.23, 86.26, 86.30, 86.31, 102.2; 173/90, 91

[56] References Cited

U.S. PATENT DOCUMENTS 3,650,335 3/1972 Lee et al. ..... 173/91

3,651,873 3/1972 Uebel et al. ..... 173/91

4,473,123 9/1984 Ranft et al. ..... 173/91

FOREIGN PATENT DOCUMENTS 0924350 4/1982 U.S.S.R. ..... 294/86.23

*Primary Examiner*—James A. Leppink

*Assistant Examiner*—Terry Lee Melius

*Attorney, Agent, or Firm*—Newton H. Lee, Jr.

[57] ABSTRACT

Stuck well pipe is removed from a well bore by applying an upward pull to the stuck pipe while applying an upward jarring action to the pipe by an air hammer which applies rapid blows to a linkage mechanism connected to the pipe.

9 Claims, 6 Drawing Figures

METHOD OF AND APPARATUS FOR REMOVING STUCK WELL PIPE

BACKROUND OF THE INVENTION

In the drilling of wells, such as water wells, through earth formation, it is the general practice to set a length of surface casing or pipe in the hole to contain the incompetent sandy and rocky earth at the top of the well and then to drill deeper through the surface pipe.

In some cases it may be that the well cannot be drilled at the selected location because of various problems which require or make removal of the surface pipe desirable. In addition the drill pipe may become stuck in the hole and difficult to remove.

While various tools are known for applying a jarring force to the stuck pipe while an upward pull is being applied, such tools are bulky and expensive, as well as costly to use and generally ineffective.

Pipe may be stuck in the hole for various reasons. For example, when the surface pipe or casing is being installed, using the typical air hammer rig, the pipe may be driven downwardly into the subterranean earth formation so that the pipe is stuck in place. Thereafter, if for some reason, the ongoing drilling through the surface pipe is not successful, the drilling operation must be moved to a new location, leaving the surface pipe in the hole if the drilling rig cannot pull the pipe from the hole.

On the other hand, from time to time, it is desirable or necessary to remove the well pipe or casing to enable remedial operations to be performed.

It is not uncommon that the conventional drill rigs cannot apply sufficient upward force on stuck casing or drill pipe to remove it from a bore hole; while in other cases stuck casing or pipe cannot be pulled out of the hole even though the drill rig can apply sufficient pull to cause the pipe to break, leaving the pipe, below the break point, stuck in the hole and generally unretrievable on an economic basis.

When the subterranean earth and rock is wedged against the pipe, in many cases, the application of a pulling force to the pipe merely results in an increased wedging of the rock against the pipe, preventing the pipe from being moved upwardly, no matter what available pulling force may be applied. However, if the pipe may be removed with a strong upward pull, many conventional drill rigs may not be capable of supplying the upward force, so that the well site must be abandoned.

SUMMARY OF THE INVENTION

The present invention provides apparatus and a method of removing stuck pipe which avoids many of the above described problems.

More particularly, the invention contemplates that a series of upwardly acting hammer blows can be effected by the same air hammer used to impose downward forces during the drilling operation, to remove a stuck pipe or fish from the hole.

In accomplishing the foregoing objectives the invention provides a tool adapted to be interposed between the hoist mechanism of the drill rig and the air hammer and also adapted to be connected to the stuck pipe, whereby the downwardly acting impact foces of the air hammer are converted to upwardly acting impact forces applied to the stuck pipe, while an upward pull is applied to the pipe. The tool can also be used to apply downward hammer blows when necessary to assist in freeing the pipe. Also, in some cases, rotation of a stuck pipe or fish is desirable to assist in freeing the pipe, and the tool can be dressed to enable such rotation.

It has been determined, in actual practice, that a drilling rig which can apply an upward pull of 20 tons may be incapable of pulling a stuck pipe, but when the upwardly acting hammer blows are applied, the pipe can be easily pulled without requiring that a more powerful rig be employed, if feasible, and without applying such upward pull as to risk breaking the pipe above the stuck point.

This invention possesses many other advantages and has other purposes which may be made more clearly apparent from a consideration of the forms by which the method may be practiced and in which it may be embodied. The preferred forms are shown in the drawings accompanying and forming part of the present application. They will now be described in detail, for the purpose of illustrating the general principals of the invention; but it is to be understood that such detailed description is not to be taken in a limiting sense.

DESCRIPTION OF THE PREFERRED EMBODIMENT

Figure 1:
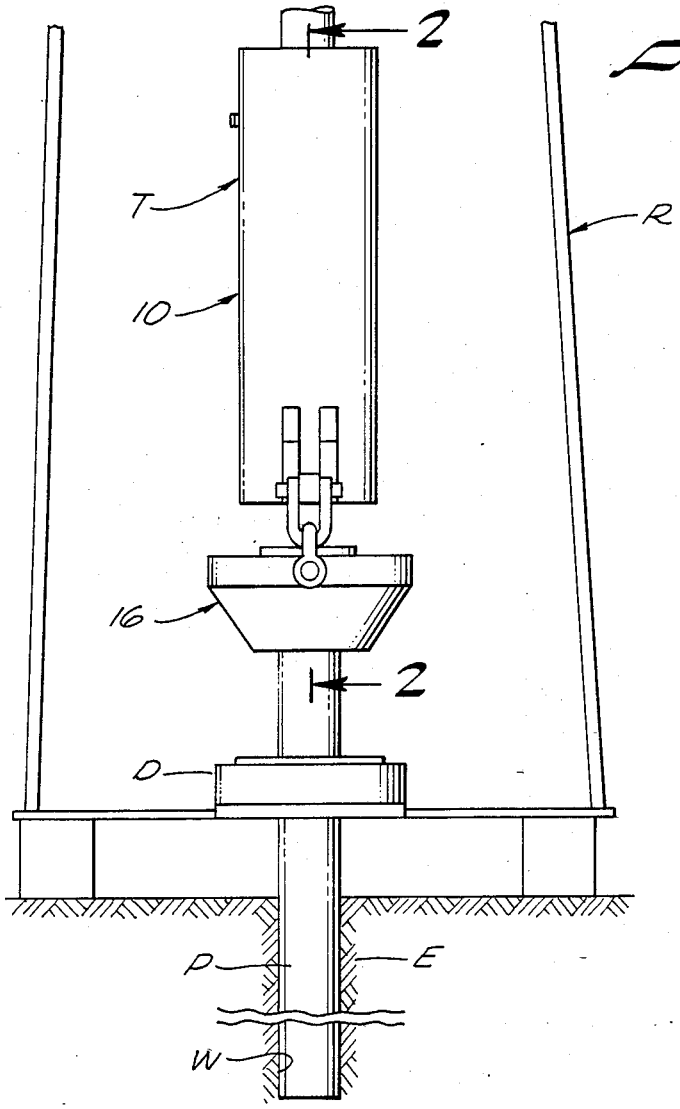
FIG. 1 is a view generally showing a drill rig equipped with the pulling and jarring apparatus of the invention.

As seen in the drawings, referring first to FIG. 1, a drill rig R of the type employed to drill well bores using an air hammer, has a rotary drive D to rotate the drill pipe or casing P as the pipe is forced downwardly into the earth formation E, by weight applied from the rig and by hammer blows applied to the pipe by the usual air hammer. Air hammers are well known and may be of the construction known as a "Mission Megadril" made by the Mission Manufacturing Company and sold by North Star Pipe and Supply Co., of Denver, Colo. Such air hammers are adapted to apply hammer blows to an anvil in the hammer structure which are transmitted to the drill bit to cause the bit to drill into the subsurface earth or rock formation.

It is unnecessary to an understanding of the present invention to further describe the drilling process employed. However, in such well drilling operations, it is customary to set surface casing or pipe at the top of the well bore W, to contain the surface rock and sand, and then to drill further through the surface pipe by use of a smaller diameter pipe.

If difficulty is encountered in drilling or completing the well, it may be necessary to remove from the well bore the surface pipe or casing or a broken or stuck drill pipe. Therefore, the present invention provides a method and apparatus for utilizing the action of the air hammer to apply an upwardly actting hammer action to the pipe to assist the pulling force applicable by the drill rig tending to remove the stuck pipe.

Accordingly a tool is provided. This tool includes a tubular or elongated body structure 10 adapted to be applied over the air hammer H when an upper length of drill pipe or collar 11 is disconnected from the housing 12 of the air hammer at a threaded joint 13. The joint 13 is remade after the tool T is lowered over the air hammer, and an upper ring 14 which is welded on the tool body 10 provides a shoulder 15 engageable with the upper end of the air hammer housing, so that the pipe 11 is subjected to an upward pull by the hoist mechanism of the rig R.

Figure 2:
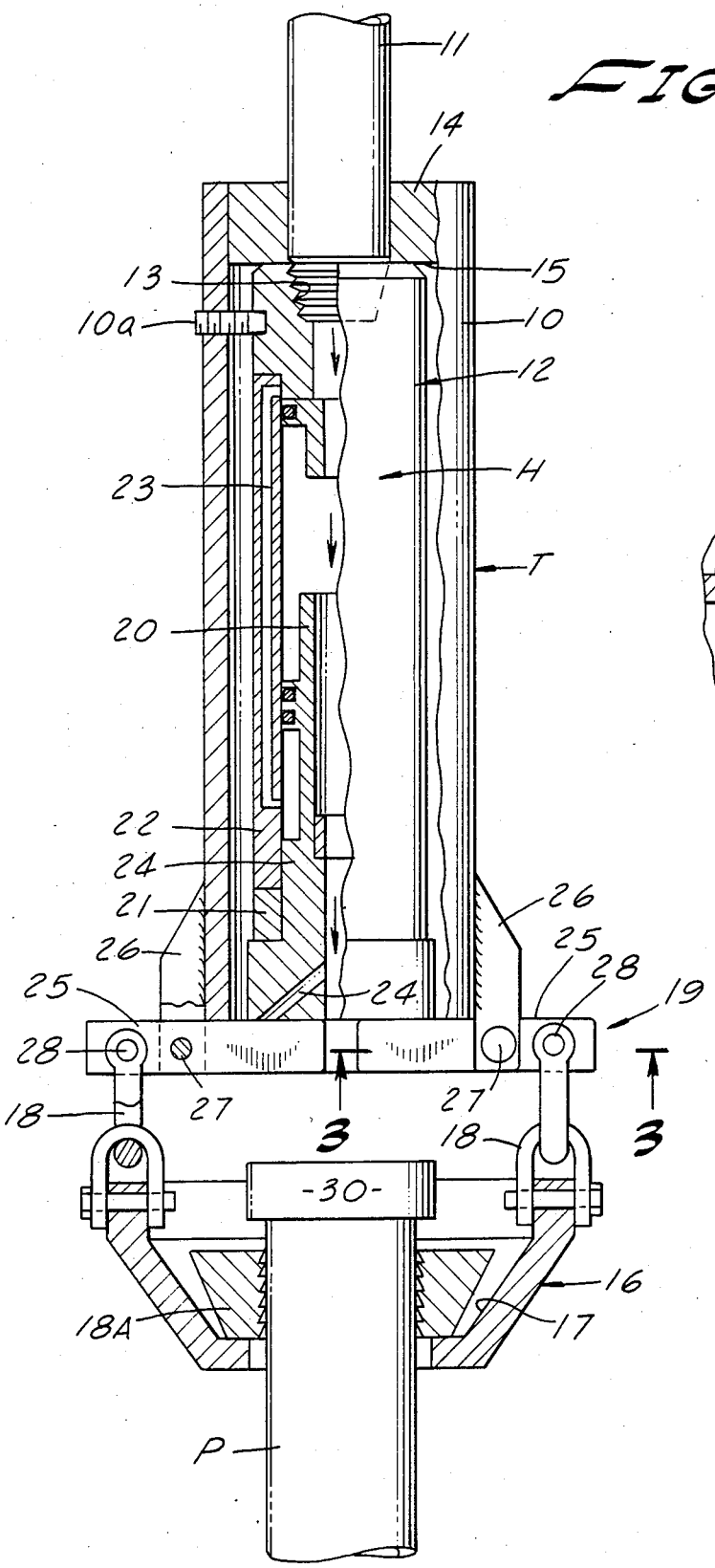
FIG. 2 is an enlarged vertical section on the line 2—2 of FIG. 1.
Figure 3:
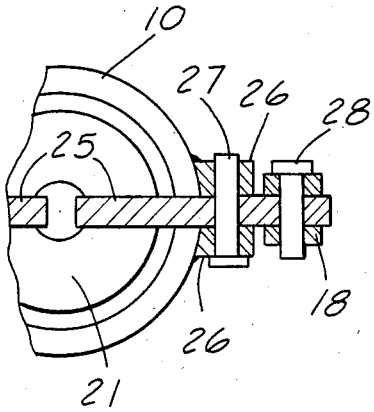
FIG. 3 is a fragmentary section on the line 3—3 of FIG. 2.

At the lower end of the body structure 10, means are provided to connect the body of the tool T, to the pipe P, so that the hoist mechanism can apply a pulling force to the upper end of the pipe P. As shown in FIG. 2, the connecting means includes a slip bowl 16 having an internal tapered bore in which tapered slips 17, having pipe engaging teeth, are adapted to be wedged into gripping relation with the pipe.

Between the slip bowl 16 and the lower end of the tool body 10 is a collapsible connection including as shown, links 18 formed by a suitable number of strong clevises connected to the slip bowl 16 and to a force transfer means 19 which are connected to the lower end of the tool body 10.

These force transfer means 19 are adapted to reverse the forces applied by the air hammer to apply an upward force to the connection 18 in response to the downward forces applied by the air hammer. The air hammer may be of any desired construction or make, wherein a hammer piston 20 is caused to reciprocate by air supplied through the pipe 11 and exhausted, as shown by the arrows in FIG. 2. Upon the downward strokes of the piston 20, it applies a succession of hammer blows to the internal anvil 21 of the air hammer. The air hammer body 22 is provided with suitable porting 23, the details of which are well known to those skilled in the art. During operation, air exhausted from the air hammer through ports 24 in the bit, enters the borehole during drilling operations to bail the cuttings from the bore hole. In some operations, drilling fluid may also be circulated through the borehole to cool the bit and remove cuttings, all as well known in the art.

The essence of the present invention resides in the concept that by employing the downwardly acting hammer blows as an upwardly directed force applied to a length of stuck pipe, the pipe can be more easily removed without requiring the application of excessive upward pull. Therefore, the force transfer means 19 is interposed between the lower end of the tool housing 10 and the means 16 for connecting the tool to the pipe.

As shown, the force transfer means includes a pair of levers 25 pivotally mounted between support ears 26 welded on the exterior of the housing 10. Pivot pins 27 extend between the ears and through the levers. At their outer ends, the levers 25 are formed for connection to the collapsible means 18. Again, I show that the upper clevis has its pins 28 extending through a hole adjacent to the outer end of the lever. It is apparent that when an upward pull is applied to the drill pipe 11, the hammer drill shoulders at 15 in the housing 10, and as upward pull is applied the levers will move to their horizontal position, as shown in FIG. 2, and the connecting means 18 will apply an upward pull on the pipe P.

The length of the tool housing 10 between the shoulder 15 and the upper sides of the levers 25, when in the horizontal position, is such that the anvil 21 is in engagement with the upper surfaces of the levers. Thus, when air is circulated through the air hammer, the hammer blows applied to the anvil 21 by the hammer piston 20 apply a downward shock force to the inner ends of the levers 25 causing an upward shock force to be applied to the outer ends of the levers 25 which is transmitted to the pipe P through the connection 18 and the connecting means or slip bowl 16 of FIG. 2.

As an upward pull is applied to the pipe 11, which is transmitted to the stuck pipe P, the upwardly acting, rapid hammer blows apply shock or vibrating forces to the pipe P, in an upward direction. As a result, the pipe is vibrated and shock loaded in such a manner as to be easily removed.

For example, it has been determined that a pipe stuck in the hole which cannot be moved by application of upward pull at full capacity may be easily pulled when the upwardly acting hammer blows are applied as described above.

Since the bit end of the air hammer must be engageable with the upper surfaces of the levers, the housing 10 of the tool body may be of different lengths to fit air hammers of different lengths. On the other hand, I may employ pipe sections of different lengths as shims between the upper end of the air hammer and the upper cap of the housing to adapt the tool to air hammers of different lengths.

I prefer to remove the usual drilling bit from the air hammer and replace it with a specially prepared bit replacement, say an old bit that has had the cutters removed or cut-off. In such case the end of the bit replacement which contacts the levers may be specially ported to assure proper exhausting of air from the air hammer. On the other hand, I may utilize a plate between the lower end of the bit and the upper sides of the levers to protect the latter or take up vertical clearance.

During use, it may happen that the pipe P resists upward movement even with the air hammer assisting, in such a case, I set down on the stuck pipe and can apply a downwardly acting hammer force to a head 30 on top of the pipe P. Under such circumstances, the collapsible connection 18 permits such downward movement of the air hammer and tool and the levers 25 pivot freely to enable contact of the air hammer with the head 30. On the other hand, I can install keys or splines between the housing 10 and the air hammer to enable rotation of the assembly. As shown, large set screws **10*a* are threaded in the housing and engage the sub of the air hammers so that the assembly is rotatable. In this case, relative longitudinal movement of housing 10 and the air hammer is also prevented so that the levers are held in the positions of FIG. 2** during downward hammering as well as upward hammering.

Figure 4:
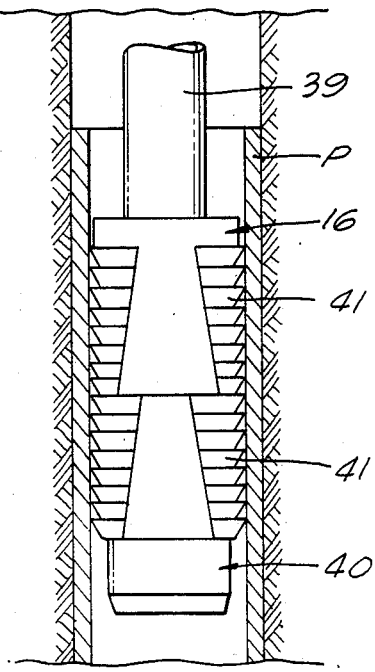
FIG. 4 is a fragmentary view showing a downhole means for connecting the pulling and jarring apparatus internally to the stuck pipe.

The present invention contemplates various connecting means 16 for connecting the tool to the stuck pipe. As seen in FIG. 4, a length of pipe is stuck in the hole below the top of the well. In this case a length of drill pipe 39 may be supported beneath the tool T and carry an anchor mechanism 40 having oppositely holding slips 41 engageable internally of the stuck pipe to anchor the tool to the pipe P for application of upward and downward forces. Such anchor structures are well known in the art as spears.

Figure 5:
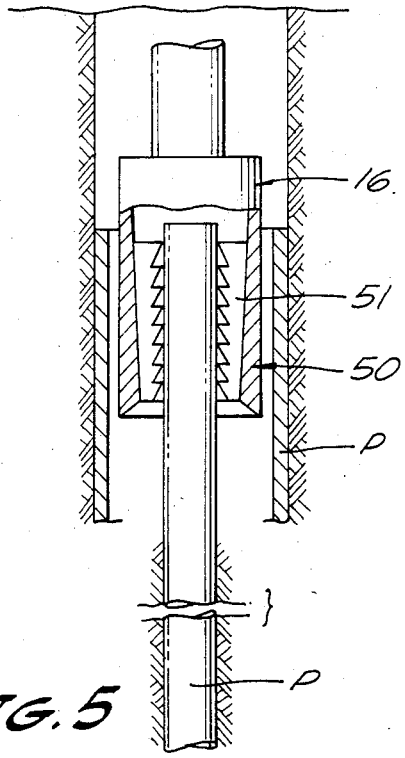
FIG. 5 is a fragmentary view showing a downhole means for connecting the pulling and jarring apparatus externally to the stuck pipe.

As seen in FIG. 5, a so-called overshot 50 having oppositely holding slips 51 may be employed to engage a stuck drill pipe P in a subsurface location within the outer wall casing. Here again the connecting means 16 is run on a length of drill pipe 39.

Figure 6:
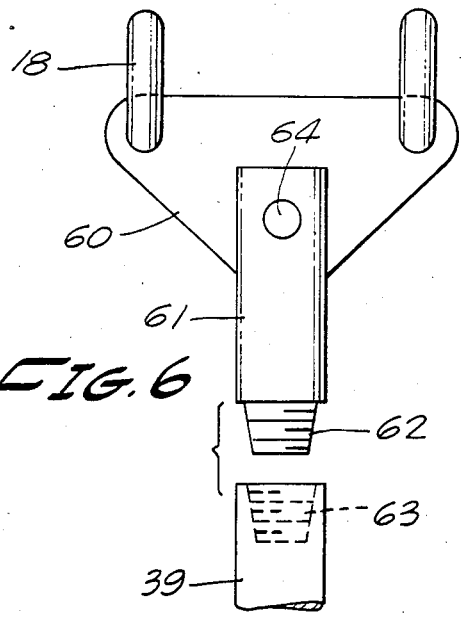
FIG. 6 is a fragmentary view showing another means for connection to the stuck pipe.

In FIG. 6, I show a means for connecting the drill pipe 39, as used in FIGS. 4 and 5, to the tool T. A plate 60 has the collapsible links or clevises 18 connected thereto. A short section of drill pipe 61 has a threaded pin 62 enagageable on the threaded box 63 at the upper end of the pipe 39. The pipe section 61 has a port 64 to enable the connecting of a circulating hose so that fluid can be circulated down the pipe 39 during the stuck pipe removal process.

From the foregoing, it will now be apparent that the present invention provides a novel method of and apparatus for removing stuck pipe from a well bore wherein the downwardly acting hammer blows of an air hammer are converted to upwardly acting hammer blows applied to the stuck pipe as an upward pull is applied.

I claim:

1. The method of removing stuck well pipe from a well bore comprises: supporting a pulling tool on the top of an air hammer, connecting the tool to the pipe, operating the air hammer to apply at least one downwardly acting hammer blow to the tool, and converting the downwardly acting hammer force to an upward force applied to the stuck pipe while applying an upward pull to the hammer.

2. The method of claim 1, including lowering the hammer, collapsing the connection between said pulling tool and said stuck pipe and applying a downwardly acting hammer force to the stuck pipe.

3. The method of claim 1, including rotating the tool and air hammer to rotate the pipe while operating the air hammer.

4. Apparatus for removing stuck pipe from a well bore comprises: an elongated body structure having a shoulder to engage the upper end of an air hammer, force reversing means at the lower of said body structure, connecting means for connecting said force reversing means to a stuck pipe, and said force reversing means having portions engageable by said air hammer to impose an upward force on said connecting means in response to a downward force applied to said force reversing means by said air hammer.

5. Apparatus as defined in claim 4, said connecting means being vertically collapsible to permit application of downward hammer forces to said stuck pipe.

6. Apparatus as defined in claim 4, said connecting means including means engageable with the exterior of said stuck pipe.

7. Apparatus as defined in claim 4, said connecting means including means engageable with the interior of said stuck pipe.

8. Apparatus as defined in claim 4, said connecting means including means enabling the circulation of a flushing fluid through said connecting means.

9. Apparatus as defined in claim 4, including means for connecting said body structure to the air hammer for rotation as a unit.

* * * * *